US006612873B2

(12) United States Patent
Reid et al.

(10) Patent No.: US 6,612,873 B2
(45) Date of Patent: Sep. 2, 2003

(54) WIRING ADAPTER FOR CONNECTING A REMOTELY OPERABLE SWITCHING DEVICE TO A CONTROL BUS

(75) Inventors: Drew A. Reid, Brentwood, TN (US); Charles E. Reneau, Murfreesboro, TN (US)

(73) Assignee: Square D Company, Palatine, IL (US)

( * ) Notice: Subject to any disclaimer, the term of this patent is extended or adjusted under 35 U.S.C. 154(b) by 289 days.

(21) Appl. No.: 09/742,996

(22) Filed: Dec. 20, 2000

(65) Prior Publication Data

US 2002/0076987 A1 Jun. 20, 2002

(51) Int. Cl.[7] ..... H01R 25/00
(52) U.S. Cl. ..... 439/638
(58) Field of Search ..... 361/628, 634, 361/636, 652, 656; 439/638

(56) References Cited

U.S. PATENT DOCUMENTS

| | | | | |
|---|---|---|---|---|
| 3,787,712 A | * | 1/1974 | Diersing | |
| 4,418,333 A | * | 11/1983 | Schwarzbach et al. | |
| 5,892,449 A | * | 4/1999 | Reid et al. | 340/629 |
| 6,095,850 A | * | 8/2000 | Liu | 439/488 |
| 6,356,422 B1 | * | 3/2002 | Bilac et al. | 361/93.1 |

OTHER PUBLICATIONS

Brochure; "POWERLOGIC Power Meter," Square D, Oct. 1998, 4 pp.
Catalog; "PowerLogic® Power Monitoring and Control Systems Catalog," Square D, Dec. 1997, 74 pp.
Panelboard Lighting Control System—Section 16440–1, 3 pages doublesided.
"Powerlink® AS Circuit Breakers—Safe, Flexible, and Loaded with Features," Square D Groupe Schneider, brochure 1995, 1 page doublesided.
"Powerlink® AS Control Modules—Compact and Sophisticated Control," Square D Groupe Schneider, brochure Sep. 1995, 2 pages doublesided.
"Powerlink™ As Lighting Control System," Square D Groupe Schneider, Oct. 1998, 26 pages doublesided.
"Powerlink® AS Software," Square D Groupe Schneider, brochure Dec. 1996, 4 pages.
"Powerlink® AS System For Industrial Applications," Square D Groupe Schneider, brochure Feb. 1997, 2 pages doublesided.
"Powerlink® AS The All–in One, Automatic Lighting Control System," Square D Groupe Schneider, brochure Oct. 1998, 3 pages doublesided.

* cited by examiner

*Primary Examiner*—Neil Abrams
(74) *Attorney, Agent, or Firm*—Michael J. Femal; Larry I. Golden

(57) ABSTRACT

A field replaceable wiring adapter for interfacing a remotely operable switching device to a control device. The wiring adapter contains a set of terminals coupled to control wires extending from the switching device, a conversion circuit, and a second set of terminals coupled to the control device. The conversion circuitry converts a bi-directional current flowing from the control device in a single current path into two separate current paths that share a common conductor. The conversion circuitry extends between the first and second sets of terminals. The mounting element is used to mount the adapter to the control device. Since the wiring adapter contains the interface circuitry and necessary terminals, it may be easily installed or replaced in the field, for upgrade or maintenance purposes, with minimal disruption to power distribution services.

19 Claims, 2 Drawing Sheets

WIRING ADAPTER FOR CONNECTING A REMOTELY OPERABLE SWITCHING DEVICE TO A CONTROL BUS

FIELD OF THE INVENTION

The present invention relates generally to remotely operable switching devices and, more particularly, to a wiring adapter for connecting a remotely operable switching device to a control bus.

BACKGROUND OF THE INVENTION

Switching devices, such as remotely operable circuit breakers and solenoid operated relays provide switching in a convenient package. Remotely operable circuit breakers additionally provide circuit protection within the same package. Manufacturers have applied the switching devices to lighting control and other applications that benefit from this capability. Many older remotely operable switching devices employ lengthy external electrical wires to connect the remote control mechanism of the switching device to an external controller. The switching device typically uses three external wires for control: a first wire is used to close the device, a second wire is used to open the device, and a third wire is used as a common conductor. With the development of newer switching devices, a companion external control device known as a control bus was introduced to allow the external wires on the switching devices to be eliminated. The newer switching devices plug directly into connectors deployed along the length of the control bus.

The present invention solves problems associated with installations that use older control devices and switching devices with external electrical wires. A user may desire to upgrade the control device to take advantage of newer technologies (e.g., control bus), but still retain the older switching devices.

SUMMARY OF THE INVENTION

Accordingly, a configurable interface between a remotely operable switching device and a control device is realized in the form of a field replaceable wiring adapter. Since the wiring adapter contains the interface circuitry and necessary terminals it may be easily replaced in the field, for maintenance or upgrade purposes, with minimal disruption to power distribution services.

The wiring adapter comprises a first set of terminals, a second set of terminals, conversion circuitry, and a mounting element. The first set of terminals is coupled to control wires extending from the switching device. The second set of terminals is coupled to the control device. The conversion circuitry converts a bi-directional current flowing from the control device in a single current path into two separate current paths that share a common conductor. The conversion circuitry extends between the first and second sets of terminals. The mounting element is used to mount the adapter to the control device.

BRIEF DESCRIPTION OF THE DRAWINGS

The foregoing and other advantages of the invention will become apparent upon reading the following detailed description and upon reference to the drawings in which.

Figure 1:
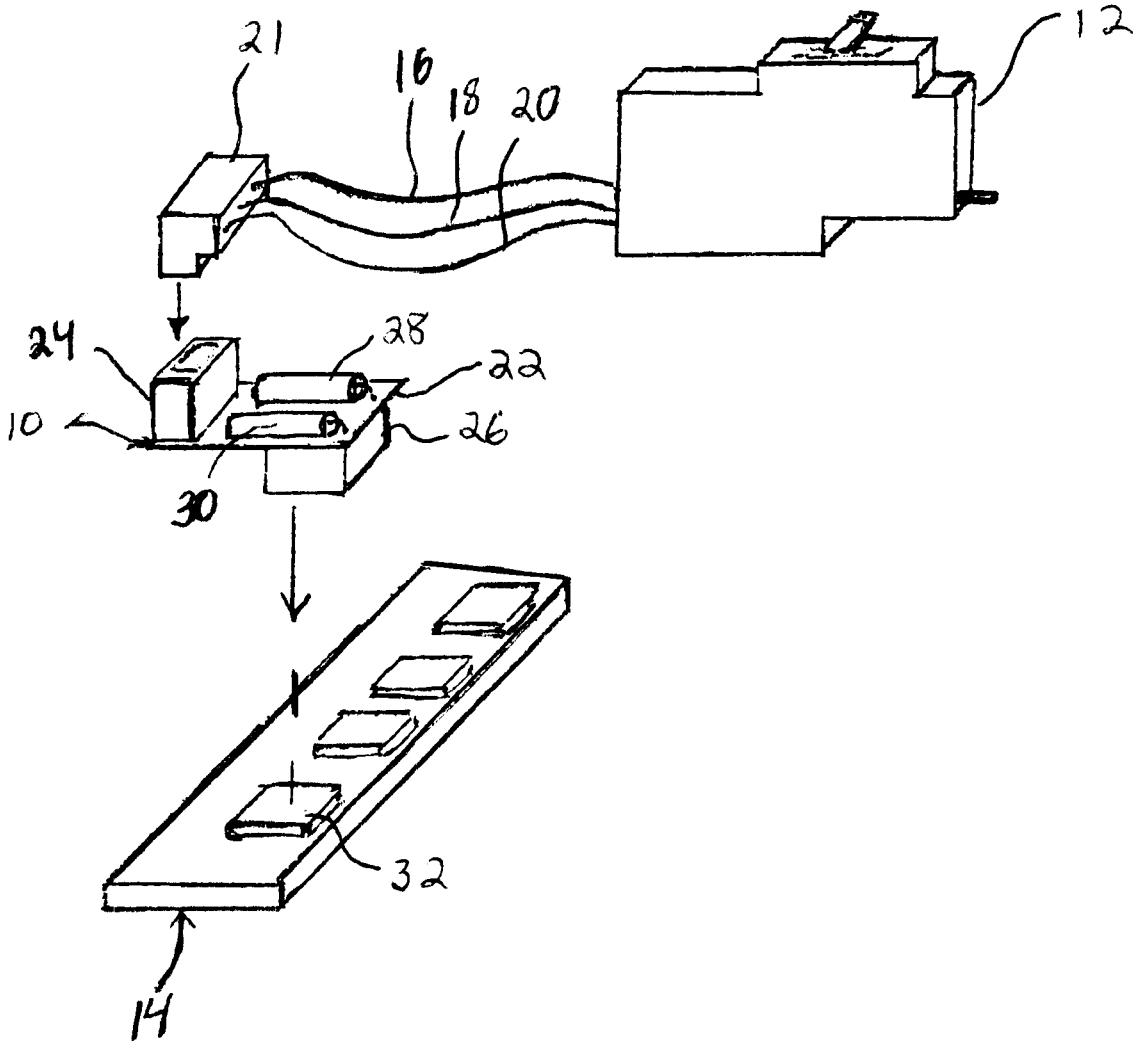
FIG. 1 is a perspective view of a wiring adapter connecting a wired switching device to a control bus, in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a wiring adapter 10 connecting a remotely operable switching device 12 to an intelligent control bus 14. The switching device 12 may, for example, be a remotely operable circuit breaker as described herein or a solenoid operated relay.

The circuit breaker 12 performs both overcurrent protection and remote switching functions on AC voltage systems. It may have a 1-, 2-, or 3-pole construction. The 2- and 3-pole circuit breakers are common trip. An overcurrent condition on any given pole of the circuit breaker 12 will cause all poles of the switching device to open. The circuit breaker 12 is capable of being opened and closed from a remote location. The circuit breaker 12 includes a stationary contact, a movable contact mounted on a carrier and a trip mechanism that trips the circuit breaker, moving the carrier to an open position upon the occurrence of an overcurrent. The remote control assembly opens and closes the circuit breaker 12 independently of the trip mechanism. Upon receiving a signal from a timer switch, a motor operates, rotating a gear spring connected to the motor shaft. An actuator has a tooth positioned between the wire layers of the gear spring. As the gear spring rotates, the tooth moves toward the motor, pivoting the actuator. An operating rod, connected to both the actuator and the carrier, pulls the carrier to open the contacts as the actuator rotates. When the contacts reach the open position, the actuator hits a switch to shut off the motor. Further details concerning the circuit breaker 12 may be obtained from U.S. Pat. No. 4,623,859 to Erickson et al., which is incorporated herein by reference in its entirety.

The control bus 14 provides a functional interconnect between the circuit breaker 12 and a control module (not shown). Specifically, the control bus 14 conducts 24VDC switching power and control signals from the control module to switch the circuit breaker 12, and report circuit breaker status back to the control module. Using surface mount technology, the control bus 14 preferably includes some intelligent switching circuitry that in prior systems was incorporated in a power interface module and/or the control module. The intelligent control bus 14 resides on a panelboard interior mounting channel and provides secure plug-in connectors, like the connector 32, for mounting the adapter 10 and other devices such as local circuit breakers (not shown) and the aforementioned control module. Further details concerning the control bus 14 may be obtained from U.S. patent application Ser. No. 09/765,915, Pub. No. U.S. 2002/0010518, filed Jan. 18, 2001, entitled "Energy Management System," incorporated herein by reference in its entirety.

Three external electrical wires 16, 18, and 20 extend between the switching device 12 and an electrical connector 21. The RED wire 16 is used to close the device 12. The BLACK wire 18 is used to open the device 12. The WHITE wire 20 is used as a common conductor.

Physically, the adapter 10 includes, among other things, a circuit board 22, a pair of electrical connectors 24 and 26, and a pair of diodes 28 and 30. The connectors 24 and 26 are mounted to opposite sides of the circuit board 22. The three-terminal connector 24 is adapted to mate with the three-terminal connector 21, while the six-terminal connector 26 is adapted to mate with a six-terminal electrical connector 32 on the control bus 14. The diodes 28 and 30 are mounted to the same side of the circuit board 22 as one of the connectors 24 and 26, in a manner that does not interfere with the mating of the connectors 24 and 26 with respective connectors 21 and 32. In an alternative embodiment, the connectors 21 and 24 are eliminated and the external wires 16, 18, and 20 are secured directly to a terminal strip on the circuit board 22 using screws or the like.

Figure 2:
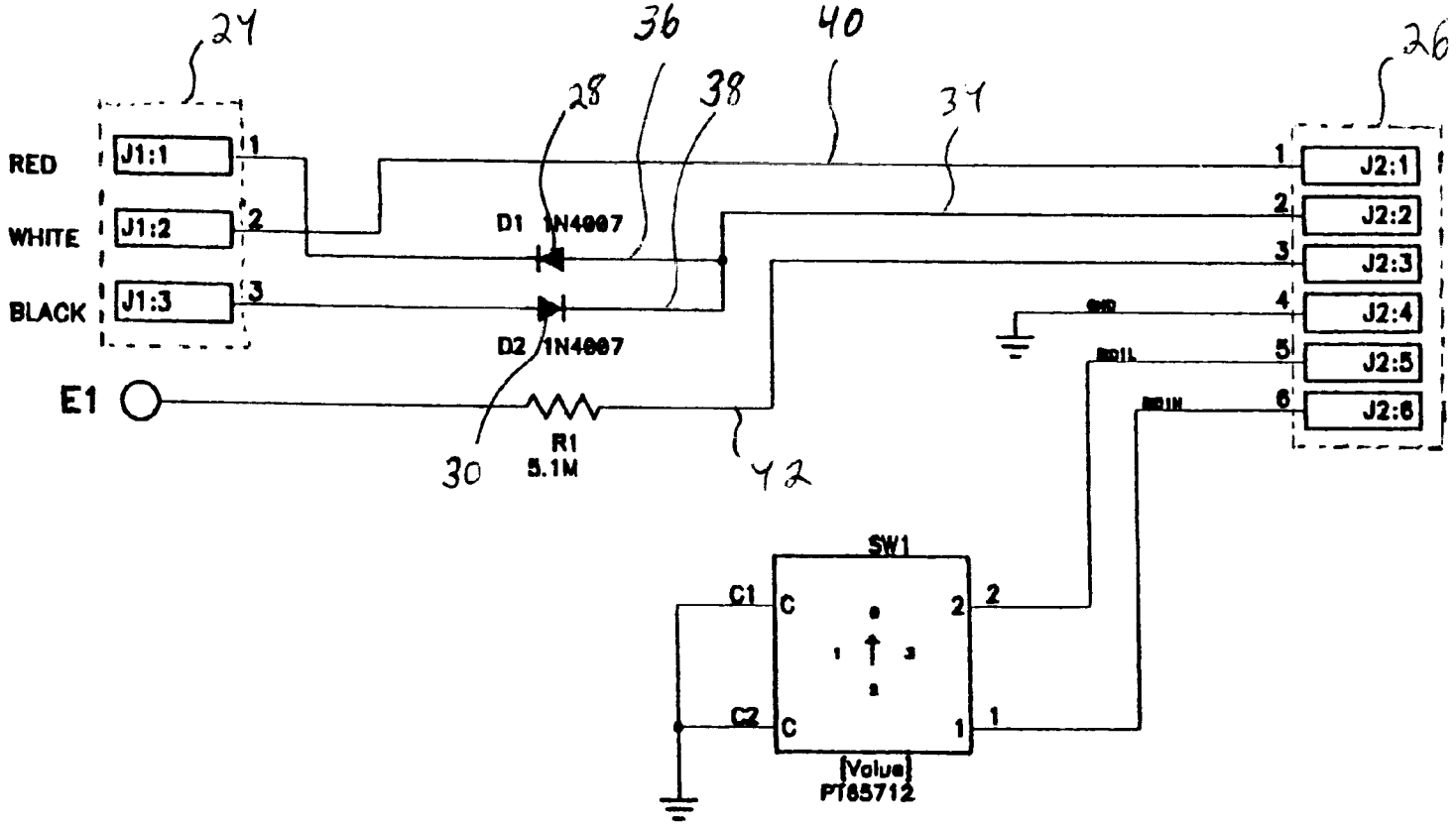
FIG. 2 is a schematic circuit diagram of the wiring adapter.

Electrically, referring to the circuit diagram in FIG. 2, the adapter 10 has a first set of terminals J1:1, J1:2, and J1:3 coupled, via the connectors 21 and 24, to the respective external wires 16, 20, and 18 (see FIG. 1) extending from the switching device 12. Specifically, the terminal J1:1 is coupled to the RED wire 16; the terminal J1:2 is coupled to the WHITE wire 20; and the terminal J1:3 is coupled to the BLACK wire 18. The adapter 10 has a second set of terminals J2:1, J2:2, J2:3, J2:4, J2:5, and J2:6 coupled, via the connectors 26 and 32, to the control bus 14.

Using a selector switch SW1 on the adapter 10, the adapter 10 identifies the 1-, 2-, or 3-pole construction of the switching device 12 to the control bus 14. If the switching device 12 has a 1-pole construction, the switch SW1 is set to 1 to electrically connect terminals J2:4 and J2:6 with no connection for terminal J2:5. If the switching device 12 has a 2-pole construction, the switch SW1 is set to 2 to electrically connect terminals J2:4 and J2-5 with no connection for terminal J2:6. If the switching device 12 has a 3-pole construction, the switch SW1 is set to 3 to electrically connect the terminals J2:4, J2:5, and J2:6. In an alternative embodiment, the selector switch SW1 is replaced with physical jumper wires that connect the terminals according to the 1-, 2-, or 3-pole construction of the switching device 12. In another alternative embodiment, the selector switch SW1 or the physical jumpers are located on the control bus 14 instead of the adapter 10.

The three-wire/two-wire conversion circuitry between the terminals J1:1, J1:2, and J1:3 and the terminals J2:1 and J2:2 converts a bi-directional current flowing from the control bus 14 in a single current path 34 into two separate current paths 36 and 38 that share a common conductor 40. The direction of current flow through the current paths 34 and 40 is reversed when controlling the switching device 12. The adapter uses the pair of diodes 28 and 30 to steer the bi-directional current into either one of the two current paths 36 and 38.

The control bus 14 includes circuitry that switches a power supply coupled to the terminals J2:1 and J2:2 for opening and closing the switching device 12. On the one hand, when the power supply applies a positive polarity to terminal J2:2 and a negative polarity to the terminal J2:1, the diode 28 is ON and allows current to pass therethrough while the diode 30 is OFF and blocks current from passing therethrough. Therefore, the positive polarity of terminal J2:2 is transmitted to the terminal J1:1 and the RED wire 16 (see FIG. 1) coupled thereto, while the negative polarity of terminal J2:1 is transmitted to the terminal J1:2 and the WHITE wire 20 (see FIG. 1) coupled thereto. The switching device 12 is configured to close in this situation. With the switching device 12 closed, current flows through the current paths 34 and 36, but not the current path 38, and returns on the common conductor 40.

On the other hand, when the power supply applies a negative polarity to terminal J2:2 and a positive polarity to the terminal J2:1, the diode 28 is OFF and blocks current from passing therethrough while the diode 30 is ON and allows current to pass therethrough. Therefore, the negative polarity of terminal J2:2 is transmitted to the terminal J1:1 and the BLACK wire 18 (see FIG. 1) coupled thereto, while the positive polarity of terminal J2:1 is transmitted to the terminal J1:2 and the WHITE wire 20 (see FIG. 1) coupled thereto. The switching device 12 is configured to open in this situation. With the switching device 12 open, current flows through the current paths 38 and 34, but not the current path 36, and returns on the common conductor 40.

The wiring adapter 10 optionally includes an additional wire 42 including a current limiting element R1 and extending between the terminal J2:3 and an independent terminal E1. The current limiting element R1 may, for example, be a resistor as shown or a capacitor. The terminal E1 is directly connected to a loadside terminal of the switching device 12. The wire 42 transmits a signal to the control bus 14 representative of the position of the switching device 12, and the control bus 14 includes sensing circuitry capable of determining the status of the switching device 12 from the signal. Because the wire 42 is directly connected to the loadside terminal of the switching device, the signal representative of the position of the switching device 12 is the voltage on the loadside terminal. The presence of a loadside voltage indicates that the switching device 12 is closed, while the absence of a loadside voltage indicates that the switching device 12 is open.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A wiring adapter for connecting a remotely operable switching device to a control device, the wiring adapter comprising:

a first set of terminals for coupling to control wires extending from the switching device;

a second set of terminals for coupling to the control device;

conversion circuitry for converting a bi-directional current flowing from the control device in a single current path into two separate current paths that share a common conductor, the conversion circuitry extending between the first and second sets of terminals; and a mounting element for mounting the adapter to the control device.

2. The wiring adapter of claim 1, further including a circuit board including the conversion circuitry.

3. The wiring adapter of claim 1, wherein the two separate current paths includes respective diodes for steering the bi-directional current through one of the two separate current paths.

4. The wiring adapter of claim 3, wherein the diodes steer the bi-directional current through one of the two separate current paths in response to different polarities applied to the second set of terminals by the control device.

5. The wiring adapter of claim 1, further including status circuitry for transmitting a signal representative of a position of the switching device from the switching device to the control device.

6. The wiring adapter of claim 5, wherein the status circuitry extends between a first additional terminal and a second additional terminal, the first additional terminal being coupled to a loadside terminal of the switching device such that the signal is a voltage at the loadside terminal, the second additional terminal being coupled to the control device.

7. The wiring adapter of claim 5, wherein the status circuitry includes a current-limiting element.

8. The wiring adapter of claim 1, wherein a first of the first set of terminals is connected to a first of the second set of terminals by the common conductor, wherein a second and a third of the first set of terminals is connected to a second of the second set of terminals by a branching current network, the branching current network including the single current path and the two separate current paths, the single current path being connected to the second of the second set of terminals, the two separate current paths branching from the single current path and being connected to the respective second and third of the first set of terminals.

9. The wiring adapter of claim 1, wherein the mounting element includes the second set of terminals.

10. The wiring adapter of claim 1, further including selection circuitry for providing an identity of the switching device to the control device.

11. A wiring adapter for connecting a remotely operable switching device to a control device, the wiring adapter comprising:

a first set of terminals for coupling to control wiring extending from the switching device;

a second set of terminals for coupling to the control device;

conversion circuitry for adapting the control wiring from the switching device to the control device such that the switching device is remotely operable with the control device, the conversion circuitry extending between the first and second sets of terminals and converting a bi-directional current flowing from the control device in a single current path into two separate current paths that share a common conductor; and a mounting element for mounting the adapter to the control device.

12. The wiring adapter of claim 11, wherein the two separate current paths includes respective diodes for steering the hi-directional current through one of the two separate current paths.

13. The wiring adapter of claim 11, further including status circuitry for transmitting a signal representative of a position of the switching device from the switching device to the control device.

14. The wiring adapter of claim 11, wherein the conversion circuitry includes a branching current network and a common conductor, the common conductor extending between a first of the first set of terminals and a first of the second set of terminals, the branching current network extending between a second and a third of the first set of terminals and a second of the second set of terminals.

15. The wiring adapter of claim 14, wherein the branching current network includes a single current path and two separate current paths, the single current path being connected to the second of the second set of terminals, the two separate current paths branching from the single current path and being connected to the respective second and third of the first set of terminals.

16. The wiring adapter of claim 15, wherein the two separate current paths include respective diodes for steering current flowing in the single current path through one of the two separate current paths.

17. A wiring adapter for connecting a remotely operable switching device to a control device, the wiring adapter comprising:

means for electrically coupling to the switching device;

means for electrically coupling to the control device;

means for mechanically coupling the adapter to the control device; and conversion means for adapting the switching device to the control device such that the switching device is remotely operable with the control device, said conversion means converting a bi-directional current flowing from the control device in a single current path into two separate current paths that share a common conductor.

18. The wiring adapter of claim 17, further including means for transmitting a signal representative of a position of the switching device from the switching device to the control device.

19. A method of connecting a remotely operable switching device to a control device, the method comprising:

coupling a first set of terminals to control wires extending from the switching device;

coupling a second set of terminals to the control device; and converting a bi-directional current flowing from the control device in a single current path into two separate current paths that share a common conductor, the conversion occurring between the first and second sets of terminals.

* * * * *